United States Patent [19]

Nerenberg

[11] 3,937,393

[45] Feb. 10, 1976

[54] TUBULAR HINGED LID CARTON

[75] Inventor: Robert W. Nerenberg, Middletown, Ohio

[73] Assignee: The Interstate Folding Box Company, Middletown, Ohio

[22] Filed: Sept. 30, 1974

[21] Appl. No.: 510,807

[52] U.S. Cl. ..... 229/51 TC; 229/51 WB
[51] Int. Cl.[2] ..... B65D 5/54
[58] Field of Search ..... 229/51 R, 51 TC, 51 WB

[56] References Cited

UNITED STATES PATENTS

| | | | |
|---|---|---|---|
| 1,673,426 | 6/1928 | Tinsley | 229/51 TC |
| 3,109,577 | 11/1963 | Knipp | 229/51 TC |
| 3,125,280 | 3/1964 | Henry | 229/51 TC |
| 3,131,852 | 5/1964 | Forbes, Jr. | 229/51 TC |
| 3,144,980 | 8/1964 | Larson | 229/51 TC |
| 3,168,974 | 2/1965 | Buttery et al. | 229/51 TC |
| 3,219,257 | 11/1965 | Anderson | 229/51 TC |
| R26,185 | 4/1967 | Henry | 229/51 TC |

*Primary Examiner*—William Price
*Assistant Examiner*—Douglas B. Farrow
*Attorney, Agent, or Firm*—Melville, Strasser, Foster & Hoffman

[57] ABSTRACT

A one-piece hinged lid carton formed from a flat-folded carton structure having a tubular body and end closure flaps, the tubular body having an additional body panel and a detachable glue flap which define the top panel and front panel of the lid, with selected end closure flap defining the side panels of the lid, the remainder of the end closure flaps defining the end walls of the carton body, the top wall of the carton body having a dispensing opening therein which is closed by the lid, and preferably the carton will be provided with a protective liner as an incident of its fabrication, with the liner adhered to the undersurface of the top wall in the area immediately surrounding the dispensing opening, thereby facilitating the puncturing of the liner for removal of the contents of the carton through the dispensing opening.

5 Claims, 11 Drawing Figures

TUBULAR HINGED LID CARTON

BACKGROUND OF THE INVENTION

The present invention relates to a hinged lid carton and has to do more particularly with a one-piece carbon structure which may be fabricated in the same fashion as a seal-end carton having a tubular body and end closure flaps which define the opposite end walls of the carbon structure. Seal-end carbons as such have been long known to the industry, such cartons being fabricated from a one-piece carton blank initially folded and glued to define a flat-folded tubular body having end closure flaps projecting from the opposite ends of the body walls. The flat-folded carbons are assembled by erecting or "squaring-up" the body walls, followed by the infolding and sealing together of the end closure flaps at one end of the carton body, whereupon the contents is introduced into the carton through the remaining open end, followed by the closing and sealing of the remaining end closure flaps to complete the package.

It has also been proposed to provide such cartons with enclosed bags or liners adapted to be associated with the carton blanks as an incident of their formation into flat-folded carton structures, as taught for example in Bergstein U.S. Pat. Nos. 2,099,257; 2,114,621; 2,114,622; 2,114,624; and 2,114,625, to name but a few. While over the years numerous improvements have been made in the apparatus and techniques for forming, filling and closing such carton structures, the cartons themselves have remained basically the same, namely, tubular cartons sealed at their opposite ends and adapted to be opened in various ways, as by cutting or tearing away all or a portion of an end closure, or by providing a pouring spout or other dispensing device. Various attempts have hitherto been made to provide a reclosable dispensing opening in the end closures, including efforts to convert an end closure into a reclosable lid. In Bergstein et al U.S. Pat. No. 3,269,635, of which the present applicant was a co-inventor, there is taught a so-called canister-type container formed from a flat-folded tubular blank, with the tubular body walls of the carton forming the top, front, bottom and rear walls of the container, and with the closure flaps defining the opposite end walls of the container. While the structure was provided with an additional body wall which defined a liftable closure flap adapted to cover a dispensing opening in the top wall of the carton body, the arrangement did not provide a lid as such, i.e., a cover with depending flanges for engaging the underlying body walls; rather, the dispensing opening was defined by a removable plug which was adhered to the inner surface of the overlying liftable closure flap, the plug reentering the dispensing opening when the closure flap was reclosed, thereby effectively reclosing the dispensing opening. While such construction will effectively reclose the dispensing opening if properly handled, the users of the cartons are often unwilling to take the time to insure that the plug is properly seated in the opening and the closure flap secured in place by its attachment tab.

In contrast to the foregoing, the instant invention provides a seal-end type carton having a true hinged lid which snugly engages about the body of the carton when closed. Consequently, in the hands of the user, the mere closing of the lid serves to effect a positive reclosure of the carton.

SUMMARY OF THE INVENTION

The invention provides a hinged lid carton fabricated from a flat-folded tubular carton blank utilizing seal-end carton handling and filling techniques, thereby adding an additional parameter to the types of carton the packager is capable of supplying utilizing his existing equipment.

In accordance with the invention, the tubular body has an additional body panel and a detachable glue flap which respectively define the top panel and the front panel of the lid, the lid-defining top panel overlying the top wall panel of the tubular body of the carton which contains a dispensing opening for the contents of the carton. The end closure flaps on the end edges of the front and rear wall of the carton body are full-depth flaps, whereas the closure flaps on the bottom wall of the carton body are half-depth flaps, as are the flaps on the ends of the panel defining the top of the lid. Half-depth attachment flaps are also hingedly connected to the opposite end edges of the glue flap which defines the front panel of the cover. It is preferred to provide additional attachment flaps on the top wall panel of the body to anchor the top wall panel to the adjoining end walls. While such additional flaps are not required in a lined structure since the top wall panel will be effectively anchored by the liner to which it is secured, they may be used to add rigidity to the stucture.

In its method aspects, the invention contemplates the selective infolding of the end closure and attachment flaps, including the juxtaposition and concurrent infolding of a half-depth closure flap and an underlying full-depth closure flap, together with the selective application of adhesive to limited areas of the infolded flaps so that, as the remaining flaps are infolded, both the body and lid parts of the carton will be formed.

Even where the carton is provided with a liner to protect the contents, it is preferred to form the carton itself from boxboard which has moisture-vapor proofing qualities. A pre-cast clay laminated boxboard, such as that taught in Bergstein U.S. Pat. No. 2,934,467 is ideally suited for the purpose in that the adhesive by means of which the cast clay coating is laminated to the board may be chosen to provide a "built-in" moisture-vapor barrier which, in itself, may afford adequate protection for the contents of the carton. However, even where a protective liner is utilized, the barrier layer in the boxboard provides protection to the contents after the liner has been severed in the area of the dispensing opening. For example, in the packaging of products such as premoistened tissues, a lined container is utilized to retain the moisture in the tissues until they are purchased by the consumer. Once the consumer has opened the carton and removed one or more tissues, a reclosure device is needed to retain the remainder of the tissues in moist condition until used. The reclosable lid construction of the present invention, particularly where the carton is formed from proofed boxboard, serves to maintain the remaining tissues in moist condition even though the liner is ruptured, the hinged lid construction providing an effective reclosure by the simple expedient of closing the lid over the body of the carton.

DESCRIPTION OF THE PREFERRED EMBODIMENTS

Figure 1:
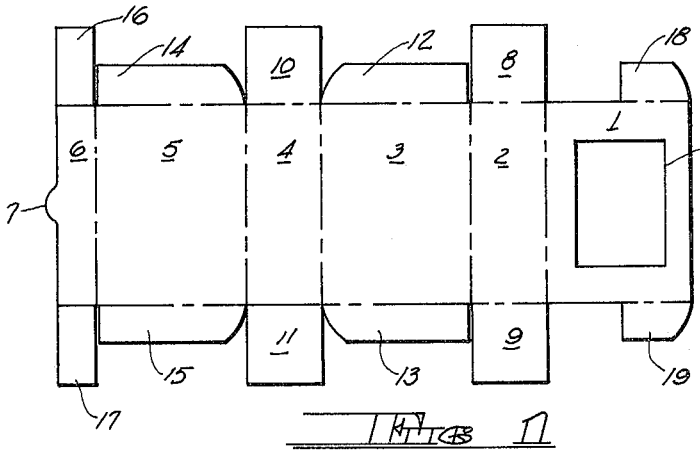
FIG. 1 is a plan view of a carton blank for a hinged lid carton in accordance with the invention.

Referring first to FIG. 1 of the drawings, a hinged lid carton in accordance with the invention is formed from a boxboard or paperboard blank which is cut and scored to define a tubular body or bottom part having a top wall panel 1, a front wall panel 2, a bottom wall panel 3, and a rear wall panel 4 in side-by-side articulation in the order named. A lid-forming top panel 5 is hingedly connected to the remaining side edge of rear wall panel 4, and a front lid panel defining glue flap 6 is hingedly connected to the opposite side of lid-forming panel 5, the glue flap preferably having an integral centrally disposed projecting tab 7 on its free side edge.

Front wall panel 2 is provided at its opposite ends with a mating pair of full-depth end closure flaps 8 and 9; and the rear wall panel 4 is provided with a similar pair of mating full-depth end closure flaps 10 and 11. As applied to the end closure flaps 8 through 11, the designation "full-depth" serves to indicate that the depth of the closure flaps is essentially equal to the depth of the front and rear wall panels 2 and 4. Bottom wall panel 3 is provided at its opposite ends with half-depth closure flaps 12 and 13; and similarly, the lid forming top panel 5 is provided at its opposite ends with half-depth closure flaps 14 and 15 which define the end panels of the lid. Half-depth attachment flaps 16 and 17 are hingedly connected to the end edges of glue flap 6. As applied to the closure flaps 12 through 15 and the attachment flaps 16 and 17, the designation "half-depth" serves to indicate that the subject flaps, when juxtaposed to the corresponding flaps 8 through 11, have a depth no greater than one-half the depth of the full-depth flaps. Where the carton is to be used in unlined condition it is preferred to provide a pair of additional half-depth attachment flaps 18 and 19 hingedly connected to the end edges of top wall panel 1; and the top wall panel 1 will also contain a dispensing opening 20 through which the contents of the carton may be removed when the lid is opened.

Figure 2:
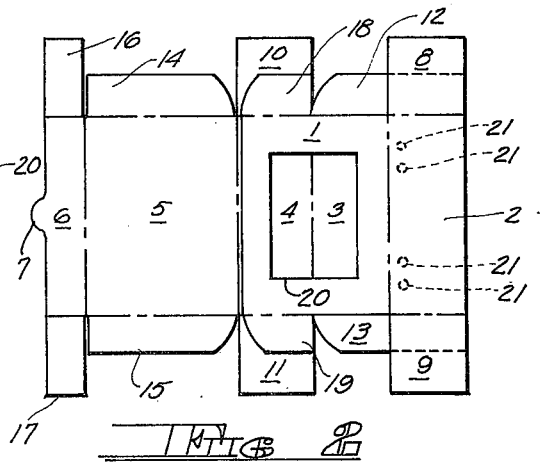
FIG. 2 is a plan view similar to FIG. 1 illustrating the initial step in the folding of the blank to form a knocked-down tubular structure.
Figure 3:
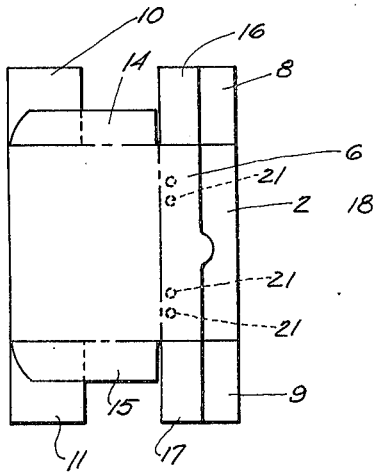
FIG. 3 is a plan view illustrating the structure in knocked-down, flat-folded condition.

The blank just described is formed into knocked-down, flat-folded condition by first infolding top and front wall panels 1 and 2 along the line of articulation connecting front wall panel 2 to bottom wall panel 3, thereby bringing the parts to the condition illustrated in FIG. 2, whereupon spaced apart dots of adhesive 21 are applied to front wall panel 2 adjacent its line of articulation to top wall panel 1. Thus, when the lid-forming top panel 5 is next infolded along its line of articulation to rear wall panel 4, the parts will assume the condition illustrated in FIG. 3 in which the glue flap 6, which also defines the front lid panel, is juxtaposed to the adhesive dots 21 and hence adhered to front wall panel 2, thereby forming the knocked-down, flat-folded structure. The carton structures may be stored in this condition and shipped to the packager for erection, filling and sealing.

Figure 4:
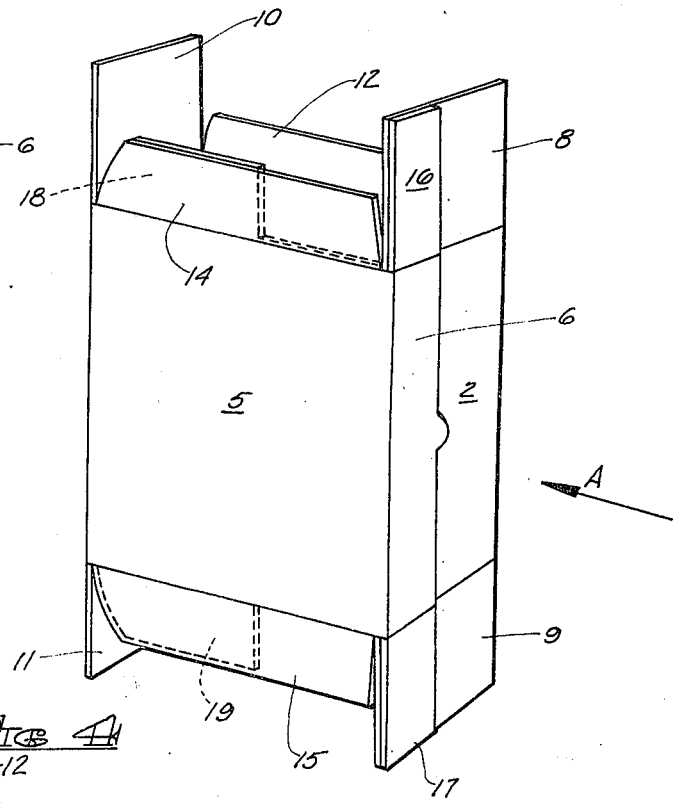
FIG. 4 is a perspective view illustrating the carton body in the erected condition prior to the infolding and gluing of the end closure flaps.
Figure 5:
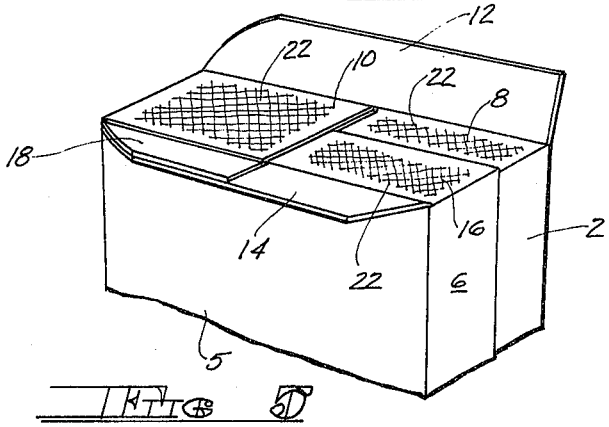
FIG. 5 is a fragmentary perspective view illustrating the infolding of the leading and trailing end closure flaps, including the application of adhesive to selected areas of the flaps.
Figure 6:
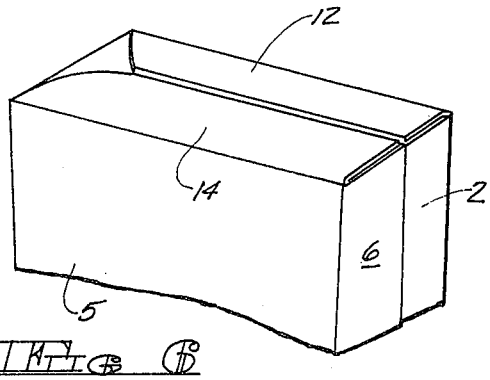
FIG. 6 is a fragmentary perspective view similar to FIG. 5 illustrating the end closure in completely folded and sealed condition.

In the hands of the packager, the carton will be erected or "squared-up" to the condition illustrated in FIG. 4, whereupon the carton will be advanced in a path of travel, as indicated by the Arrow A, for a series of folding and gluing steps which will close and seal the opposite ends of the carton. In the embodiment illustrated, the half-depth flaps 12 and 14 are first folded outwardly, together with the additional attachment flap 18, whereupon the full-depth end closure flap 10 is infolded, together with the concurrent infolding of the full-depth end closure flap 18 and the overlying half-depth attachment flap 16, thereby bringing the parts to the condition illustrated in FIG. 5. Adhesive is then applied to the exposed surfaces of the flaps 8, 10 and 16, as indicated at 22 in FIG. 5, whereupon the flaps 12 and 14 are infolded to the condition illustrated in FIG. 6, the infolding of the flap 14 resulting in the concurrent infolding of half-depth attachment flap 18. Thus, half-depth closure flap 12 is adhesively secured to the full-depth end closure flaps 8 and 10 to define an end wall of the carton, and the additional attachment flap 18 is secured to full-depth end closure flap 10. The half-depth flap 14, which defines one of the lid end panels, is secured only to the underlying lid attachment flap 16. It will be understood that the opposite end of the carton will be folded and glued in like manner, the sequence as between the top and bottom ends depending upon the nature of the folding and gluing equipment. If the equipment is of the type which will fold and seal the flaps at the lowermost end of the carton body, the lowermost end will be closed and sealed first, followed by the introduction of the contents and the closing and sealing of the flaps at the uppermost end of the carton body. Otherwise, the closure flaps at the uppermost end will be closed and sealed, the carton inverted, filled with contents, and the remaining end closed and sealed.

Figure 7:
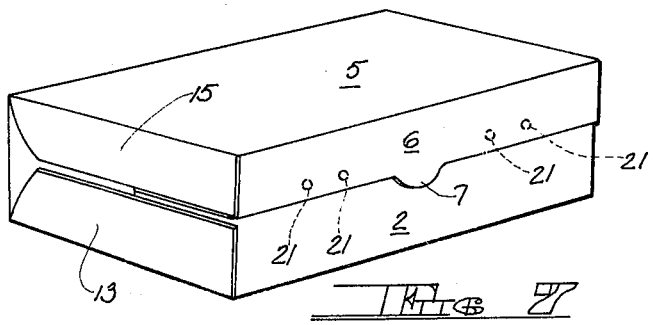
FIG. 7 is a perspective view of the completed carton in its intended position of use.
Figure 8:
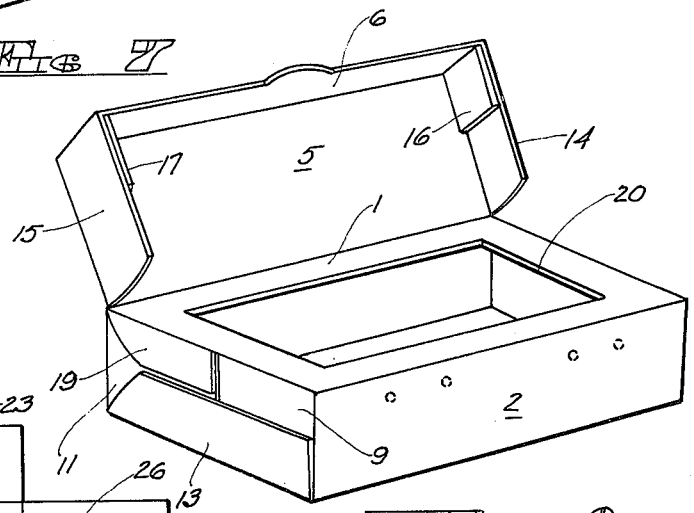
FIG. 8 is a perspective view similar to FIG. 7 illustrating the carton with its lid in the open position.

FIG. 7 illustrates the closed and sealed carton in its intended position of use. When it is desired to open the carton, the user will grasp the tab 7 and deflect the front lid panel 6 outwardly relative to the underlying front wall panel 2, thereby breaking the adhesive seal in the areas of the adhesive dots 21. In order to facilitate the detachment of lid panel 6, it may be found desirable to surround the adhesive dots 21 with circular lines of severance extending at least partially through the boxboard so that the board will split as the lid panel 6 is separated from the underlying front wall panel 2. The lid may then be opened upwardly, in the manner illustrated in FIG. 8, to expose the contents of the carton through the dispensing opening 20. It will be noted that the lid end panels 14 and 15 will be free from attachment to the underlying full-depth closure flaps 10 and 11 due to the interposition of the additional attachment tabs 18 and 19 which are adhered to the end closure flaps 10 and 11, the additional tabs serving to securely anchor the top wall panel 1 to the carton body. It should also be evident that the carton may be readily reclosed simply by folding the lid downwardly, the lid front panel 6 and end panels 14, 15, together with the tabs 16 and 17, engaging snuggly about the front and end walls of the carton body to effect a snug reclosure.

Figure 9:
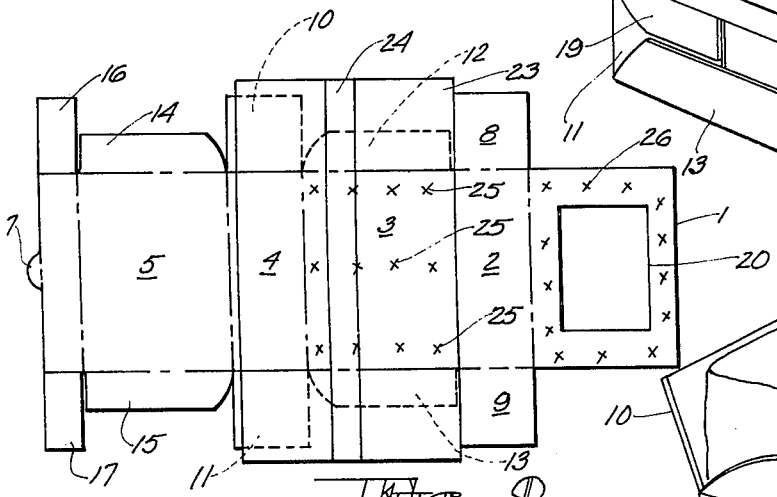
FIG. 9 is a plan view similar to FIG. 1 illustrating a carton blank with juxtaposed tubular liner.
Figure 10:
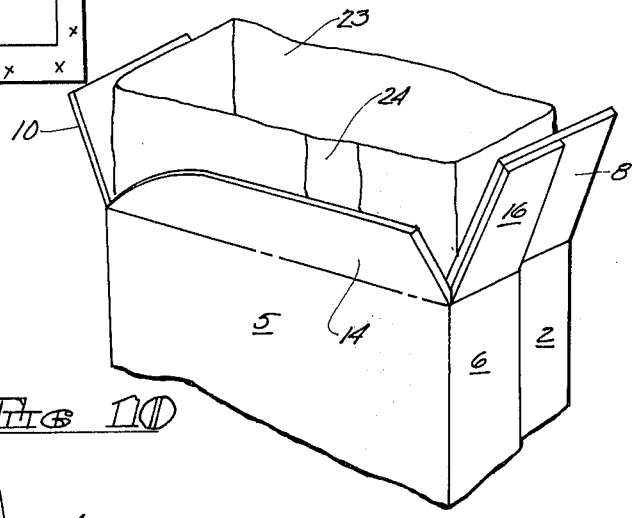
FIG. 10 is a fragmentary perspective view illustrating the lined carton in erected condition prior to the closing and sealing of the liner and end closure flaps.

FIG. 9 illustrates a modification of the invention wherein the carton structure is provided with a liner. The carton blank is essentially the same, and like parts have been given like reference numerals, although in this embodiment the additional attachment tabs on the end edges of top wall panel 1 have been eliminated. The liner 23 comprises a flat-folded tube having a longitudinal seam 24, although the liner may be seamless depending upon the material from which it is formed. In the flat-folded condition the liner is of a width to span bottom and rear wall panels 3 and 4, and of a length to extend sufficiently beyond the opposite ends of the body walls to permit closing and sealing of the liner ends. In the embodiment illustrated, the liner 23 is adhered to wall panel 3 by means of adhesive stripes 25 and additional ahesive, indicated at 26, is applied to top wall panel 1 in an area surrounding the dispensing opening 20 so that when the carton blank is infolded and glued to form a knocked-down tubular structure, the liner will also be adhered to top wall panel 1. While the liner also may be adhered to wall panels 2 and 4 if desired, such additional adhesion is unnecessary since adhesion of the liner to an opposing pair of the body wall panels is sufficient to expand the liner when the carton body is erected, the erection of the carton body bringing the parts to the condition illustrated in FIG. 10. When in this condition, it will be understood that one of the extending ends of the liner will be first sealed and folded to lie within the confines of the carton body, followed by the infolding and attachment of the adjoining end closure flaps, whereupon the carton will be filled with the closed end downwardly, followed by the sealing of the remaining end of the liner and the closing and sealing of the remaining end closure.

Figure 11:
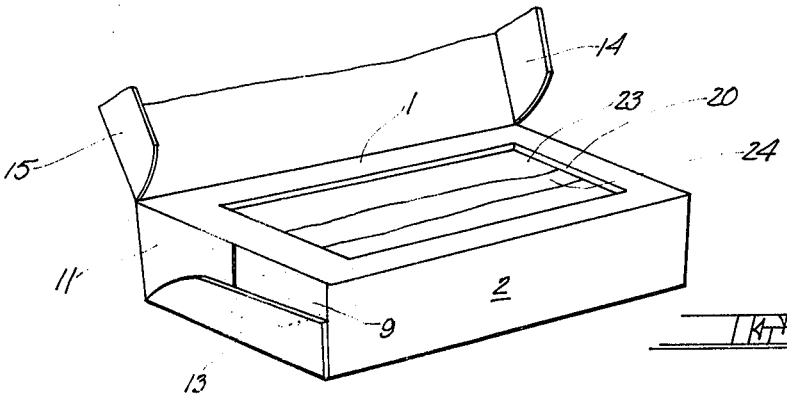
FIG. 11 is a fragmentary perspective view illustrating the lined carton with its lid in the open position.

When the lined carton is opened, as illustrated in FIG. 11, the liner will be exposed through the dispensing opening 20 and the exposed portion removed either by tearing or by severing the liner about the periphery of the dispensing opening. Removal of the exposed portion of the liner is facilitated by the adhesive attachment of the liner to the undersurface of the top wall panel 1 in the area surrounding the dispensing opening. Where the top panel is adhesively attached to the liner, the additional attachment tabs used to hold the top wall panel 1 in place may be eliminated since the liner itself will serve such function. However, the additional attachment flaps also may be used in a lined structure for added rigidity.

As should now be evident, the instant invention provides a tubular hinged lid carton which may be readily opened and easily reclosed and effectively resealed, the carton being either lined or unlined depending upon the nature of the material being packaged. Modifications may be made in the invention without departing from its spirit and purpose, and various modifications have already been set forth and others will undoubtedly occur to the worker in the art upon reading this specification. By way of example, a savings in boxboard can be obtained by eliminating the top wall panel 1 in its entirety. While the structure will lose some of its rigidity, such modification is nonetheless adequate for a number of uses, particularly where the carton is provided with a liner.

The embodiments of the invention in which an exclusive property or privilege is claimed are defined as follows:

1. A tubular hinged lid carton having a body and an integral lid formed from a one-piece carton blank having at least a front wall panel, a bottom wall panel, a rear wall panel, a lid-forming top panel, and a front lid panel, hingedly connected together in the order named, full-depth end closure flaps hingedly connected to the opposite end edges of said front and rear wall panels, half-depth end closure flaps hingedly connected to the opposite end edges of said bottom wall panel, half-depth lid end panels hingedly connected to the opposite end edges of said lid-forming top panel, and half-depth attachment flaps hingedly connected to the opposite end edges of said front lid panel, the said wall panels being erected relative to each other with said full-depth end closure flaps infolded and said half-depth end closure flaps infolded and adhesively secured to the lower portions only of said full-depth closure flaps to define the end walls of the carton body, the lid-forming top panel being infolded with said front lid panel detachably secured to the said front wall panel, the half-depth lid end panels and the half-depth attachment flaps being infolded and secured together over the upper portions only of said full-depth end closure flaps to define a closed and sealed hinged lid carton.

2. The tubular hinged lid carton claimed in claim 1 including a tubular liner disposed within the carton body, said liner being adhered to a plurality of said wall panels.

3. The tubular hinged lid carton claimed in claim 2 including a top wall panel hingedly connected to the upper edge of said front wall panel, said top wall panel having a dispensing opening formed therein, said top wall panel being adhesively secured to said liner in an area surrounding said dispensing opening.

4. The tubular hinged lid carton claimed in claim 1 including a top wall panel hingedly connected to the upper edge of said front wall panel, said top wall panel underlying said lid-forming top panel and having a dispensing opening therein which exposes the contents of the carton when the lid is opened.

5. The tubular hinged lid carton claimed in claim 4 including additional attachment flaps hingedly connected to the opposite end edges of said top wall panel, said additional attachment flaps being infolded and secured to the full-depth end closure flaps connected to said rear wall panel.

* * * * *